US009324109B1

(12) United States Patent
Joseph et al.

(10) Patent No.: US 9,324,109 B1
(45) Date of Patent: Apr. 26, 2016

(54) PROACTIVE PRICING

(75) Inventors: B. Anthony Joseph, Bellevue, WA (US); Matthew K. Green, Seattle, WA (US); Srikanth Thirumalai, Clyde Hill, WA (US); Pranav Dandekar, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 1818 days.

(21) Appl. No.: 12/039,816

(22) Filed: Feb. 29, 2008

(51) Int. Cl.
*G06Q 30/00* (2012.01)
*G06Q 30/08* (2012.01)

(52) U.S. Cl.
CPC ..... *G06Q 30/08* (2013.01)

(58) Field of Classification Search
CPC ..... G06Q 30/08
USPC ..... 705/26, 27
See application file for complete search history.

(56) References Cited

U.S. PATENT DOCUMENTS 6,058,379 A 5/2000 Odom et al.
7,062,460 B1 6/2006 Growney et al.
2002/0138392 A1* 9/2002 LeBlanc ..... 705/37
2006/0064369 A1* 3/2006 Moeller ..... 705/37
2006/0206412 A1* 9/2006 Van Luchene et al. ..... 705/37

OTHER PUBLICATIONS

Lucking-Reiley et al., "Business-to-Business Electronic Commerce," The Journal of Economic Perspectives, Winter 2001, v15n1pgs55-68, ProQuest Dialog #212080787, 16pgs.*

* cited by examiner

*Primary Examiner* — Rob Pond
(74) *Attorney, Agent, or Firm* — Thomas | Horstemeyer, LLP

(57) ABSTRACT

Disclosed are various embodiments of systems, methods and computer programs for proactive pricing. An offer to sell a product extended by a seller is maintained in a server. The offer to sell includes a plurality of asking terms and at least one selling rule authorizing a deviation from the asking terms and that is associated with the offer. A plurality of purchase offers from at least one buyer to purchase the product is maintained in the server. Each of the purchase offers specifies at least one purchase term. The purchase offers are ranked based upon a degree to which the respective purchase terms match the asking terms.

30 Claims, 9 Drawing Sheets

113aa

113ab

113ac

113ad

113b

PROACTIVE PRICING

BACKGROUND

Buyers and sellers in a retail setting often engage in fixed price and fixed terms transactions in an electronic commerce system. Existing electronic commerce systems provide for fixed price transactions. Buyers and sellers often have different asking terms under which they are willing to consummate a transaction. Consequently, sales may be lost due to a disconnect between the asking prices of buyers and sellers.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
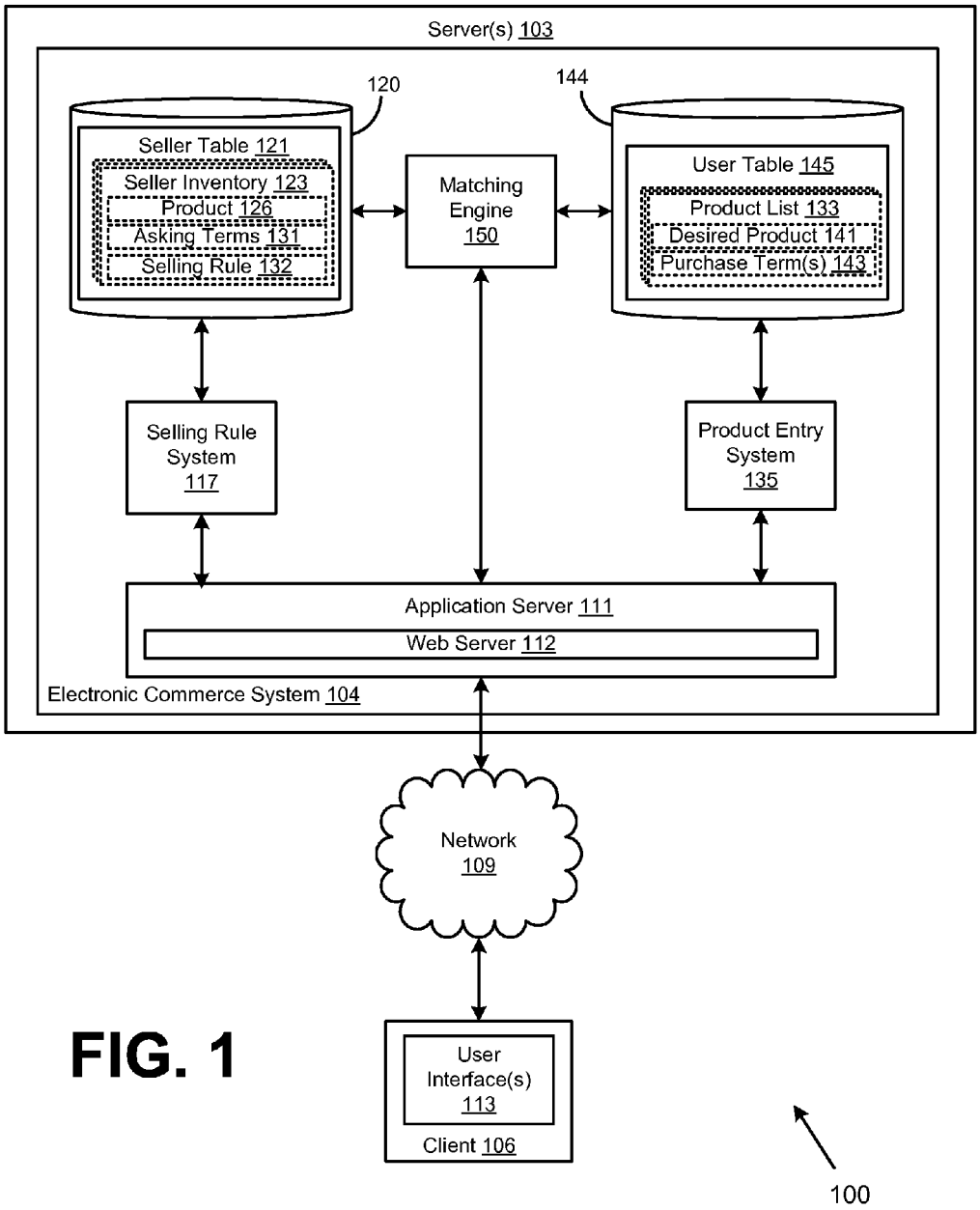
FIG. 1 is a drawing of a network having a client and an exemplary server that facilitates proactive pricing in an electronic commerce system according to an embodiment of the present disclosure.

With reference to FIG. 1, shown is a networked environment 100 for providing for proactive pricing and the matching of offers among buyers and sellers that includes, for example, at least one server 103 implementing an electronic commerce system 104 and at least one client 106. The server 103 may represent multiple servers that may be arranged to work in coordination with each other. Alternatively, such servers may be arranged in some other manner, as can be appreciated. The client 106 is representative of multiple clients 106 that are configured to access information on the server 103 or electronic commerce system 104. Both the server 103 and the client 106 are coupled to a network 109. The network 109 may include, for example, any type of network environment such as the Internet, intranets, local area networks, wide area networks (WANs), wireless networks, cellular networks, phone networks, or other suitable networks as can be appreciated or any combination of two or more such networks.

According to various embodiments, the server 103 includes various applications that are executed, for example, to effect order fulfillment for a buyer or seller in the electronic commerce system 104. To this end, an application server 111 is executed in the server(s) 103, which may in turn execute other systems for interacting with a client 106 via the network 109. Systems running in an application server 111 in an electronic commerce system 104 may include, but are not limited to, order fulfillment systems, dynamic network or web page servers, inventory systems, or other systems as can be appreciated. However, such systems are not described herein in detail.

Various user interfaces 113 are generated on a display device of the client 106 to facilitate interaction with the various systems or components implemented on the server 103 and within the application server 111. In this way, buyers and sellers within the electronic commerce system 104 may interact with the various systems executed within the electronic commerce system 104. The client 106 is configured to interface with the various systems on the server 103 in order to effect the viewing of products, product listings, to enter offers to sell and/or purchase products within the electronic commerce system 104, and for other purposes as can be appreciated. With respect to the various embodiments, the client 106 interfaces with the application server 111 and its various applications via the web server 112.

A seller in the electronic commerce system 104 can interface with a selling rule system 117 to enter selling rules associated with products sold by the seller. Shown is a product data store 120 that includes information regarding sellers in the electronic commerce system 104 including a seller table 121. For each seller, the seller table 121 includes a seller inventory 123 that can include information regarding the inventory of the various sellers in the electronic commerce system 104. A record within the seller inventory 123 associated with a seller includes a product 126, asking terms 131 and optionally one or more selling rules 132 associated with the product 126. The asking terms 131 can include terms associated with the product 126 as it is listed or published by the seller within the electronic commerce system 104 for sale to buyers in a fixed price transaction. For example, the asking terms 131 can include an asking price set by the seller to sell the product 126. It should be appreciated that various asking terms 131 can be specified by a seller, which can include but are not limited to the asking price, haggling price, lowest acceptable price, various shipping options/charges, payment forms and other terms associated with the sale of a product in the electronic commerce system 104.

A selling rule 132 associated with a product 126 is a rule defined by a seller that authorizes the electronic commerce system 104 to either deviate from or modify the asking terms 131 of the product 126. For example, a selling rule 132 can authorize the electronic commerce system 104 to deviate from an asking price of a product 126 in order to consummate a sale with a buyer seeking the product at a price lower than the price embodied in the asking terms 131. In this way, a seller can effectively "haggle" or negotiate the settlement terms of a product 126 with a buyer in the electronic commerce system 104 by specifying a selling rule 132 authorizing settlement terms differing from the asking terms 131. However, the selling rule 132 can specify that the differing settlement terms are authorized only for such negotiated or haggled transactions. Therefore, the selling rule 132 can operate without modifying the asking terms 131 as they are listed or published to other buyers in association with the product 126.

Alternatively, a selling rule 132 may authorize or instruct the electronic commerce system 104 to modify the asking terms 131 of the product 126 on a specified date, which may occur in the future. In this way, in contrast to the above example, the selling rule 132 can include a temporal indicator, which is discussed in further detail hereinbelow, that causes the selling rule system 117 to modify the asking terms 131 in the seller inventory 123 on a date specified by the selling rule 132. Accordingly, the asking terms 131 that are listed or published to buyers in association with the product 126 can be modified on such dates in the future. A seller may employ such a selling rule 132 to proactively price a product 126 depending on the date that a product 126 is retrieved or viewed by a buyer in the electronic commerce system 104.

As a non-limiting example, the seller may seasonally raise and/or lower the price of a particular seasonal product in the seller inventory 123. In other words, a seller may define a selling rule 132 to cause the selling rule system 117 to raise the price of a product 126 when demand is high and lower it when demand is low. It should be appreciated that the selling rule system 117 may authorize the electronic commerce system 104 to modify asking terms 131 associated with a product 126 other than the price. For example, a selling rule 132 can authorize the electronic commerce system 104 to modify the shipping cost or other terms presented to a buyer as can be appreciated. It should also be noted that the above structure of the product data store 120 and the seller inventory 123 is but one example thereof, and that other structures or hierarchies may be employed as can be appreciated.

As an additional non-limiting example, a selling rule 132 can include a property or asking term 131 of the transaction, such as, for example, asking price, product condition, shipping rate, shipping terms and/or other asking terms 131 that should be appreciated. The selling rule 132 can also include as well a value of the asking term 131 that the seller wishes to define for a particular product in the electronic commerce system 104. A selling rule 132 can also include one or more dimensions along which the above noted asking term 131 might be varied by the system 104. Such a dimension can include, but is not limited to: product demand, quantity, date, buyer location, buyer rating, shipping location, sales tax, or other such dimensions that should be appreciated. Accordingly, the selling rule 132 can instruct the electronic commerce system 104 to define the asking terms 131 of the product 126 according to a dimension and a specified value for the dimension. For example, a selling rule 132 can be defined according to the following format:

<price, $50.00, date, 02/01/2010>

The above selling rule 132 authorizes the electronic commerce system 104 to set a price of a product to $50.00 on Feb. 1, 2010. Therefore, a selling rule 132 can be defined to set any asking term 131 of the product according to any dimension.

To facilitate entry of a selling rule 132 associated with a product 126 by the seller, the selling rule system 117 can also facilitate the generation of one or more user interfaces 113 within a client 106 in the network 109. A seller can accordingly communicate with the selling rule system 117 via the network 109 and web server 112 by manipulating the user interface(s) 113 to cause the selling rule system 117 to store a selling rule 132 associated with a product 126 in the seller inventory 123 and to perform other functions as will be described.

The depicted server 103 is also configured to receive offers to purchase a product from a user or buyer via client 106. An offer to purchase can be received in the form of a product list 133, or "wish list" of products that a user desires. A user may manipulate a user interface 113 presented by the server 103 to the client 106 in order to add or enter items to such a product list 133. A user may manipulate the user interface 113 and cause the product entry system 135 to store an offer to purchase a product in the user data store 144 in the user table 145 by submitting a desired product 141 in conjunction with at least one purchase term 143. The purchase term 143 indicates a condition or term under which a buyer is willing to purchase the desired product 141 in the electronic commerce system 104. An offer to purchase in accordance with an embodiment of the disclosure is an offer to purchase the desired product 141 within the electronic commerce system 104 that contractually binds a buyer to purchase the product if the offer is accepted by a seller.

However, as noted above, the product list 133 may also be referred to as a "wish list," as an item may be entered by a user for addition to a product list 133 without a purchase term 143. Accordingly, an entry in the product list 133 may represent an item that is merely desired by a user and does not represent a binding offer to purchase the item. Therefore, a user may simply add such an item to the product list 133 by manipulating the user interface 113 in the client 106 that provides for the addition of the desired product 141 to the product list 133 without a purchase term 143.

A record within the product list 133 associated with a user in the electronic commerce system 104 can include a desired product 141, and can optionally include a purchase term 143 associated with each desired product 141. A purchase term 143 can include any attribute, condition, or asking term associated with a desired product 141 that a user may wish to include as a term of a binding purchase offer extended within the electronic commerce system 104. For example, a user may enter an offering price that designates the maximum price the user is willing to pay for a desired product 141 from a seller in the electronic commerce system 104. In other words, the purchase term 143 comprises at least one condition under which a buyer is willing to purchase a desired product 141 for which the buyer has extended an offer.

As an alternative example, a buyer may extend an offer to purchase a desired product 141 at a specified offering price, but the buyer may also desire that the desired product 141, if fulfilled, be gift-wrapped at no additional charge or shipped via a specified shipping method. Accordingly, the buyer may specify one or more purchase terms 143 associated with the desired product 141 that reflects these one or more desires. A buyer may also specify via a purchase term 143 that an offer to purchase a desired product 141 expires on a specified date. Additionally, a buyer may extend an offer to purchase having a purchase term 143 of an initial offering price for a desired product 141, but may also express via a second purchase term 143 that he is willing to increase the offering price by a specified amount in order to receive the desired product 141. In this way, a user may effectively haggle or negotiate over the purchase of a desired product 141 in the product list 133 without the necessity of engaging in active negotiation or a back and forth haggling process. Other exemplary purchase terms 143 can also include, but are not limited to, a price, a shipping method, a seller rating, a payment method, payment terms, and a seller reputation requirement.

As an additional non-limiting example, an offer to purchase, similar to a selling rule 132, can include a property or asking term 131 of the transaction, such as, for example, an asking price, product condition, shipping rate, shipping terms and/or other asking terms 131 that should be appreciated. The offer to purchase can include as well a value of the asking term 131. Accordingly, the offer to purchase can also include one or more dimensions along which the asking term 131 might vary. Such a dimension can include, but is not limited to: product demand, quantity, date, seller identify, seller location, seller rating, shipping location, sales tax, or other such dimensions that should be appreciated. Accordingly, a buyer may define multiple conditions upon which an offer to purchase is contingent according to a dimension and a specified value for the dimension. In other words, a buyer can define one or more purchase terms 143 for an offer to purchase.

Because buyers and sellers can extend offers to purchase and sell products within the electronic commerce system 104, respectively, the matching engine 150 can match such offers to a corresponding offer and cause transactions to be consummated. For example, the matching engine 150 can locate a purchase offer from a user that is associated with a desired product 141 stored within the user data store 144, and match it with an offer to sell that is extended by a seller and stored within the product data store 120. Upon locating an offer to sell and an offer to purchase having terms matching one another, the matching engine 150 can automatically consummate a transaction for the sale of the product within the electronic commerce system 104. Alternatively, the matching engine 150 on behalf of a buyer may locate a product 126 within the seller inventory 123 and apply a selling rule 132 that authorizes a deviation from the asking terms 131 to match the purchase terms 143 of an offer to purchase. Likewise, the matching engine 150 may on behalf of a seller also locate a desired product 141 within the user data store 144 and apply a purchase term 143 in order to match the asking terms 131 or selling rule 132 of an offer to sell.

For example, the matching engine 150 can locate a desired product 141 and purchase term 143 forming a binding offer to purchase in the electronic commerce system 104. If the purchase terms 143 of the offer to purchase are not satisfied by the asking terms 131 associated with products in the seller inventory 123 of various sellers, then the matching engine 150 can apply at least one selling rule 132 associated with the product 126 to deviate from the asking terms 131 and match the above purchase terms 143.

If upon deviating from the asking terms 131 according to a selling rule 132, the matching engine 150 can locate an offer to sell and an offer to purchase having terms that satisfy one another, the matching engine 150 can then cause a transaction between the buyer and seller to be consummated within the electronic commerce system 104. It should be appreciated that the selling rule 132 can comprise a plurality of selling rules authorizing the matching engine to deviate from or modify the asking terms 131 associated with a product 126 in a seller inventory 123. For example, a seller may specify a plurality of selling rules 132 associated with a product 126, such as, for example, a selling rule 132 authorizing the deviation from asking terms 131 including, but not limited to, the asking price, the shipping terms, or other asking terms 131 as can be appreciated.

It should be further appreciated that because a selling rule 132 may potentially only authorize the electronic commerce system 104 to deviate from or modify the asking terms 131 associated with a product 126 on a specified date occurring in the future, the matching engine 150 may be unable to immediately locate a purchase offer satisfying the asking terms 131 and selling rule 132 associated with a product 126. However, the matching engine 150 may apply such a selling rule 132 on a date in the future if the purchase offer remains in the user data store 144 and consummate the sale.

The matching engine 150 may also operate to locate a product 126 having the lowest price or most beneficial asking terms 131 on behalf of a buyer. For example, the matching engine 150 can retrieve offers to sell that are stored within the product data store 120 and are associated with a desired product 141 of a buyer. Accordingly, the matching engine 150 may locate the asking terms 131 associated with the product 126 that are most favorable to the buyer subject to the purchase terms 143 located within the product list 133 of the buyer. In addition, the matching engine 150 may rank the offers based upon the degree to which the asking terms 131 and/or selling rule 132 authorizing a modification or deviation from the asking terms 131 match the purchase terms 143. That is to say, some of the asking terms 131 may not entirely match the purchase terms 143. In other words, the matching engine 150 can rank offers to sell from sellers in the electronic commerce system 104 according to how closely the asking terms 131 and/or selling rule 132 match the purchase terms 143 defined by the buyer.

Alternatively, even if a matched offer cannot be located, the matching engine 150 may rank products from the product data store 120 in this way according to the degree that the asking terms 131 of a product 126 match the purchase terms 143 defined by the buyer. Accordingly, the matching engine 150 can present to a buyer an offer to sell in the electronic commerce system 104 that most closely matches a desired product 141 and purchase terms 143 defined by the buyer. Alternatively, the matching engine 150 can also consummate a transaction on behalf of the buyer with the offer to sell that most closely matches the purchase offer.

Similarly, the matching engine 150 may also operate to locate an offer to purchase from among the purchase offers in the user data store 144 that are most favorable to a seller. For example, the matching engine 150 can retrieve offers to purchase from the product lists 133 of the various users of the electronic commerce system 104 and consummate a transaction between a seller and a buyer having the most favorable purchase terms 143 subject to the asking terms 131 and selling rule 132 associated with the product 126 in the seller inventory 123. As a non-limiting example, the most favorable purchase term 143 can correspond to a buyer seeking a desired product 141 and defining an offering price that is higher relative to other buyers in the system.

Similar to the above ranking example, the matching engine 150 may rank purchase in the user data store 144 according to the degree that the purchase terms 143 defined by the various users match the asking terms 131 or selling rule 132 of a seller. For example, an offer to purchase extended by a buyer that requires less deviation from the asking terms 131 and/or selling rule 132 of a seller can be ranked higher relative to an offer to purchase that requires more deviation from the asking terms 131. In other words, the matching engine 150 may rank the purchase offers based upon the degree to which the purchase terms 143 match the asking terms 131 and/or selling rule 132 authorizing a deviation from or modification of the asking terms 131. In this way, the matching engine 150 may operate to allow buyers and sellers alike to receive a "best price" from their respective points of view.

To accomplish the ranking of offers as contemplated herein, a weighting system may be employed that assigns weights to offers based on the terms associated therewith, with a higher weight indicating a closer match with the terms. For example, the matching system 150 may assign the highest weight to a price term that is contained in an offer to sell or a purchase offer, while assigning lower weights to other terms, such as, shipping method, user rating, user reputation, payment method, and other terms as can be appreciated. Offers can accordingly be ranked using such a weighting system according to the degree that they match one another. It should be appreciated that the above example is but one weighting system that can be used to rank offers in the electronic commerce system 104 relative to one another. Other weighting system can be employed as can be appreciated.

As another example, buyers and/or sellers in the electronic commerce system 104 can specify a priority for each term of an offer to purchase or an offer to sell, respectively. Therefore, if a buyer, for example, deems that a price is of the highest priority, and other terms of an offer to purchase, such as, shipping terms, are less important, then the matching system 150 can rank offers to sell a product according to the specified priorities of the buyer. Alternatively, the matching system 150 can infer which of the terms of an offer are of the highest priority. For example, the matching system 150 can operate on the assumption that price is of the highest priority and rank offers under this assumption. As yet another alternative, the matching system 150 may learn the preferences of a user by examining the user's historical specified priorities and rank terms of an offer accordingly. For example, if the matching system 150 can identify that a user more often than not specifies shipping cost as the highest priority purchase term 143 of an offer to purchase, then the matching system 150 can rank an offer to purchase associated with the buyer according to shipping cost if the buyer has not specified any such priorities for the offer.

Figure 2:
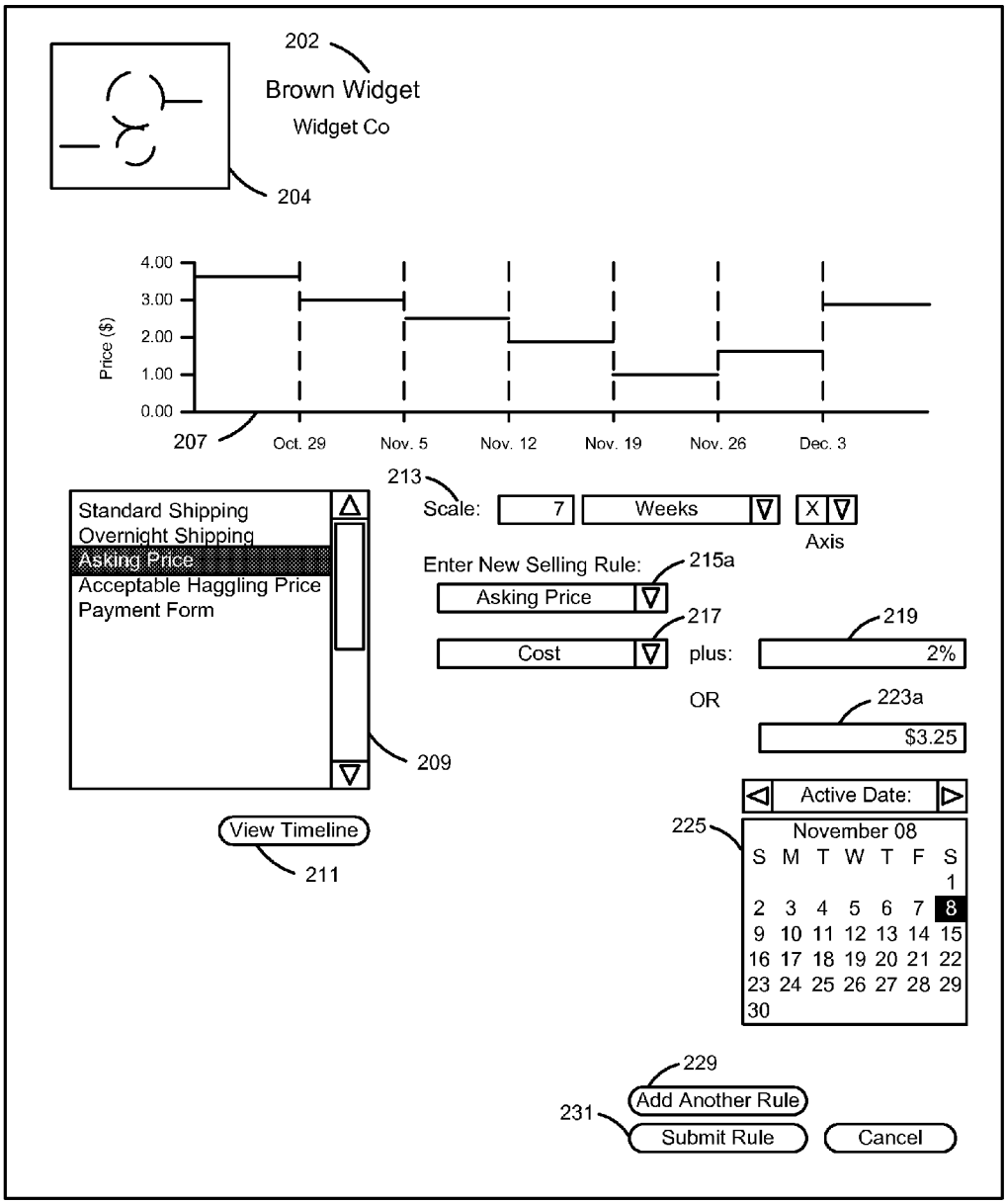
FIG. 2 is a drawing of an example of a user interface that is generated on a client in the network by the electronic commerce system of FIG. 1 according to an embodiment of the present disclosure.

With reference to FIG. 2, shown is one example of a user interface 113*aa* that facilitates the entry of selling rules by a seller. The depicted user interface 113*aa* may be hereinafter referred to as a selling rule entry page. The selling rule entry page communicates with the selling rule system 117 (FIG. 1) in order to effectuate the entry of selling rules 132 (FIG. 1) associated with a product 126 (FIG. 1) in the seller inventory 123 (FIG. 1). Shown are various exemplary user interface elements in order to facilitate the entry of selling rules 132. However, it should be appreciated that the same may be accomplished with other user interface elements using a variety of layouts and/or workflows.

In the depicted example, the selling rule entry page can communicate further product details to a seller, including a product description 202 and at least one product image 204 providing a picture of the product. The depicted selling rule entry page further includes a timeline element 207 that indicates to a seller the pricing or other terms of a product 126 over time. In the depicted example, the timeline element 207 indicates the change in pricing over time. A seller may cause the user interface to graphically depict various asking terms 131 (FIG. 1) of the product 126 in the timeline element 207 by manipulating the asking term display element 209. For example, a seller may manipulate the asking term display element 209 to cause the timeline element 207 to display an alternative asking term over time, such as, for example, the standard shipping charges associated with a product.

A seller can further cause the timeline element 207 to display or update by manipulating the timeline viewing element 211. It should be appreciated that various asking terms 131 can be viewed by a seller in connection with a product 126 in the seller inventory 123, which can include, but are not limited to, the asking price, various shipping charges, payment forms and other terms associated with the sale of a product in the electronic commerce system 104. It should also be appreciated that the timeline element 207 may also graphically depict more than one asking term at any one time.

Additionally, the selling rule entry page further includes a scale element 213, which allows a user to alter the depicted scale of the timeline element 207. For example, a seller can manipulate scale element 213 in order to modify the data depicted within the timeline element as well as the scale of a selected axis as can be appreciated.

Also shown in depicted selling rule entry page is a selling rule selection element 215*a*, which allows a seller to choose a type of selling rule 132 for entry via the selling rule system 117. In the depicted example, a seller may choose to enter a selling rule 132 regarding an asking price of the product 126 by manipulating the selling rule selection element 215*a* to reflect the asking price. Subsequently, the selling rule entry page can depict various alternative elements facilitating a seller to enter a selling rule 132 authorizing the electronic commerce system to deviate from or modify an asking price of a product. For example, cost element 217, in conjunction with percentage element 219 can allow a seller to define an asking price that is based on the cost to the seller of a product plus a specified markup entered in the percentage element 219.

It should be appreciated that, in this way, the asking price can be based on various terms. For example, cost element 217 can allow a seller to base an asking price of a product on a manufacturer's retail suggested price plus a specified markup entered in the percentage element 219. Alternatively, the seller may wish to enter a negative or zero percentage in the percentage element 219, causing the asking price to be lowered or remain unchanged relative to the field selected by cost element 217, respectively. As another alternative, a seller may wish to enter the value of an asking price in a number entry element 223*a*. If a seller does not desire to base the asking price on a cost, manufacturer's retail suggested price, or the like, then the seller may enter the value of the asking price in the number entry element 223*a*.

As noted above, a selling rule 132 may authorize the electronic commerce system 104 to deviate from or modify the asking terms of a product on a specified date that can be in the future. Accordingly, the temporal indicator element 225 allows a seller to select a date upon which the selling rule entered via the selling rule entry page will become active. In other words, the depicted user interface 113*aa* includes the temporal indicator element 225 to allow a user to proactively price a product 126 in the future. As noted above, a seller may, for various reasons, wish to define a selling rule 132 authorizing the electronic commerce system 104 to modify an asking term 131 such as an asking price of the product on a date in the future. Accordingly, the temporal indicator element 225 allows the seller to specify such future date.

The seller may also wish to associate multiple selling rules with a single product 126 in the seller inventory 123 by manipulating the additional submission element 229, which facilitates the addition of multiple selling rules 132 into the selling rule entry page. Alternatively, by manipulating rule submission element 231, the seller can submit a selling rule 132 and cause the selling rule system 117 to store the entered selling rule in the product data store 120. Consequently, the selling rule 132 can be associated with a product 126 in the seller inventory 123.

Figure 3:
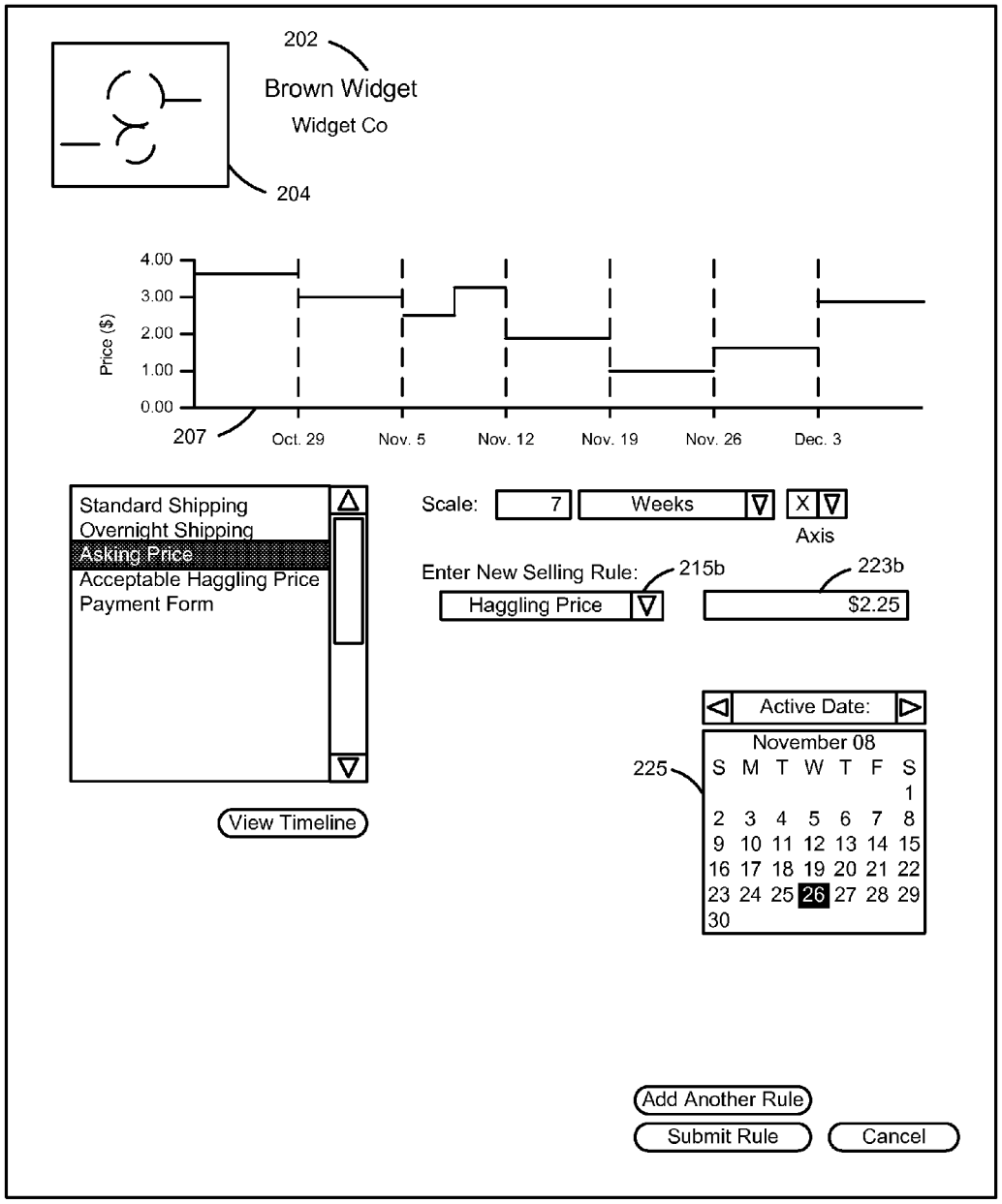
FIG. 3 is a drawing of an example of a user interface that is generated on a client in the network by the electronic commerce system of FIG. 1 according to an embodiment of the present disclosure.

With reference to FIG. 3, shown is an alternative example of a user interface 113*ab* facilitating the entry of a selling rule 132 (FIG. 1). The depicted user interface 113*ab* of FIG. 3 may also be hereinafter referred to as a selling rule entry page. The selling rule entry page communicates with the selling rule system 117 (FIG. 1) in order to effectuate the entry of selling rules 132 associated with a product 126 (FIG. 1) in the seller inventory 123 (FIG. 1). In the depicted user interface 113*ab*, the selling rule entry page can also communicate further product details to a seller, including a product description 202 and at least one product image 204 providing a picture of the product. Similar to the above user interface 113*aa* of FIG. 2, the user interface 113*ab* of FIG. 3 includes a selling rule timeline 207 displaying a specified asking term associated with the product 126 over time. The selling rule timeline 207 is a graphical depiction reflective of one or more selling rules 132 associated with the product 126 that authorize the electronic commerce system 104 to deviate from or modify the asking terms 131 (FIG. 1) of the product 126 on at least one specified date.

Also shown in depicted selling rule entry page of FIG. 3 is an alternative selling rule selection element 215*b*, which allows a seller to choose the type of selling rule 132 for entry via the selling rule system 117. In the depicted example, a seller may choose to enter a selling rule 132 reflecting a haggling price of the product 126 by manipulating the selling rule selection element 215*b* to reflect a haggling price. Subsequently, the user interface 113*ab* can display a number entry element 223*b* allowing a seller to enter a haggling price, which is a price a seller may be willing to accept if an offer to purchase having a matching purchase term 143 (FIG. 1) can be located in the user data store 144 (FIG. 1) by the matching engine 150 (FIG. 1).

It should be appreciated that such a haggling price may vary from an asking price, which is a price that is published or advertised to other users of the electronic commerce system 104 (FIG. 1). Accordingly, a seller may express a willingness to accept a price that varies from a published asking price by entering a haggling price via the user interface 113*ab*. Such willingness can allow a seller to realize some sales at a higher published asking price while also realizing a quantity of sales at a lower haggling price for users unwilling to pay the higher published asking price.

Similar to the above selling rule entry page of FIG. 2, the depicted user interface also includes the temporal indicator element 225 allowing a seller to select a date upon which the selling rule 132 entered via the selling rule entry page will become active. In other words, the depicted user interface 113*ab* likewise includes the temporal indicator element 225 to allow a user to proactively price or otherwise modify other asking terms 131 of the product 126 on specified dates. As noted above, a seller may, for various reasons, wish to define a selling rule 132 authorizing the electronic commerce system 104 to deviate from or modify an asking term 131 on a date in the future. Accordingly, in the depicted example of FIG. 3, the temporal indicator element 225 allows the seller to specify a date upon which the electronic commerce system 104 may use the haggling price entered in the number entry element 223 to consummate transactions with other buyers.

Figure 4:
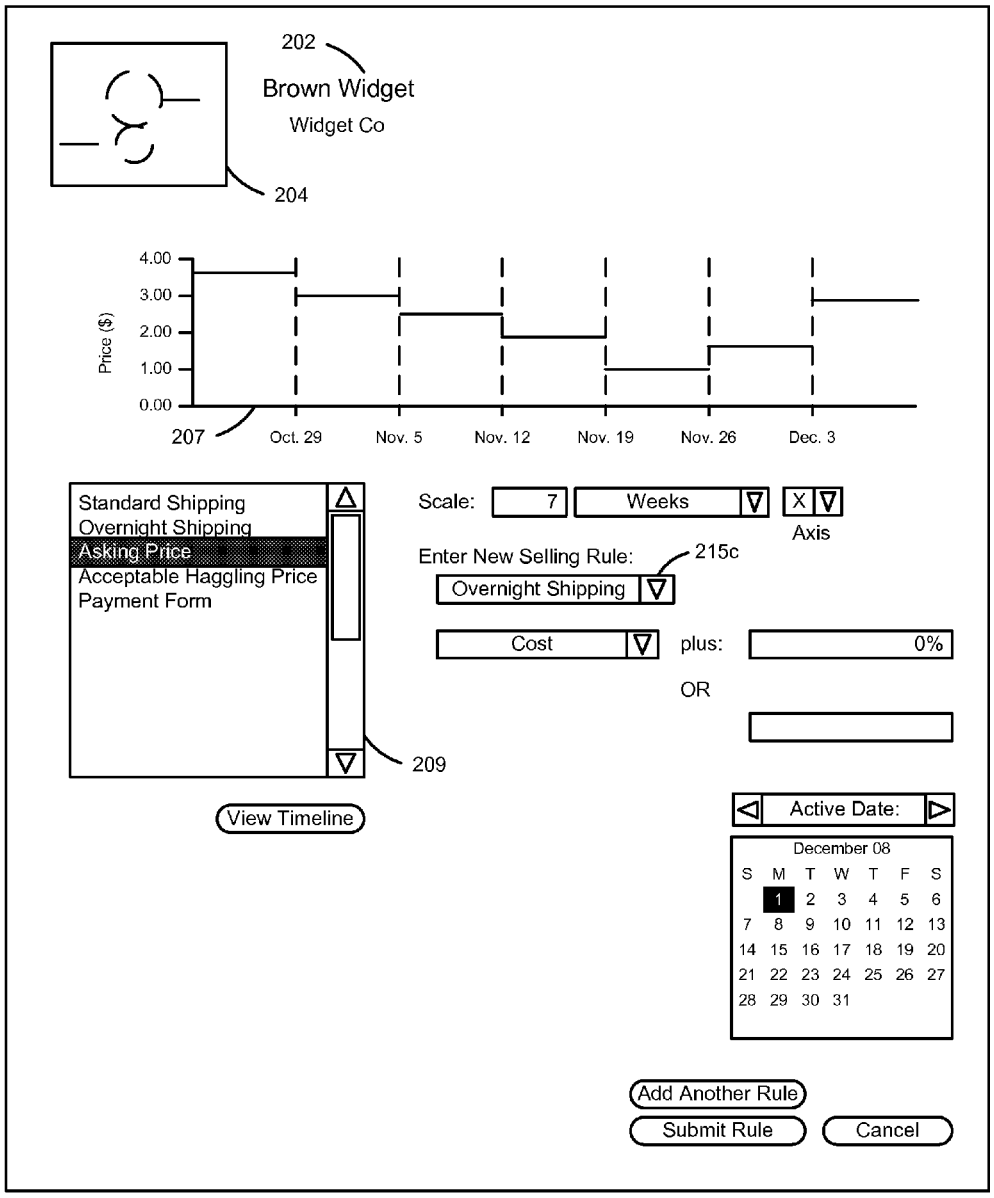
FIG. 4 is a drawing of an alternative example of a user interface that is generated on a client in the network by the electronic commerce system of FIG. 1 according to an embodiment of the present disclosure.

With reference to FIG. 4, shown is an alternative example of a user interface 113*ac* facilitating entry of a selling rule 132 (FIG. 1). The depicted user interface 113*ac* of FIG. 4 may also be hereinafter referred to as a selling rule entry page. The user interface 113*ac* communicates with the selling rule system 117 (FIG. 1) in order to effectuate the entry of selling rules 132 associated with a product 126 (FIG. 1) in the seller inventory 123 (FIG. 1). Also shown in depicted selling rule entry page of FIG. 4 is an additional alternative example of a selling rule selection element 215*c*, which allows the seller to choose the type of selling rule for entry via the selling rule system 117.

Figure 5:
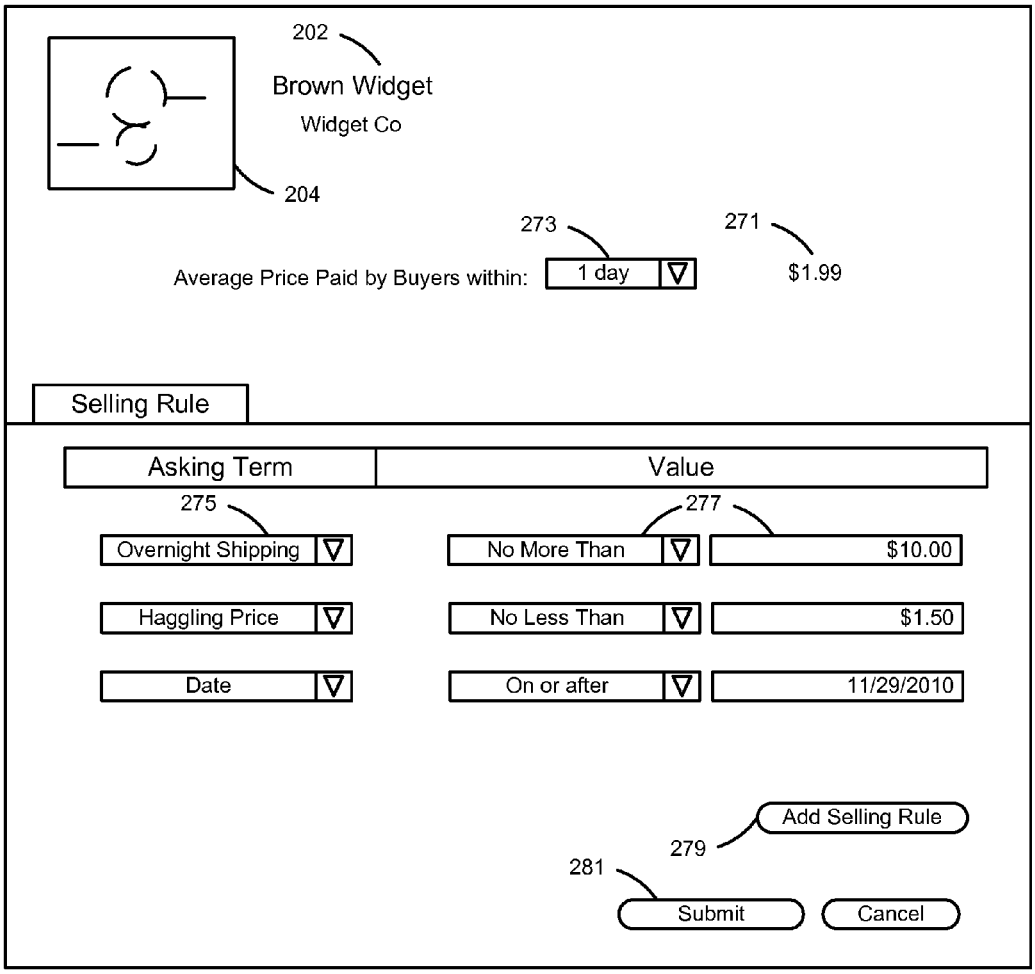
FIG. 5 is a drawing of an alternative example of a user interface that is generated on a client in the network by the electronic commerce system of FIG. 1 according to an embodiment of the present disclosure.

With reference to FIG. 5, shown is an alternative example of a user interface 113*ad* facilitating entry of a selling rule 132 (FIG. 1). The depicted user interface 113*ad* of FIG. 5 may also be hereinafter referred to as an alternative selling rule entry page. The user interface 113*ad* communicates with the selling rule system 117 (FIG. 1) in order to accommodate the entry of selling rules 132 associated with a product 126 (FIG. 1) in the depicted alternative selling rule entry page.

The alternative selling rule entry page can also include an average price paid indicator 271 and an average price paid history element 273, which can, in conjunction with one another, communicate to a seller the average price paid for the product 126 by buyers in the electronic commerce system 104. Further, a seller may display the average price paid for the product 126 over a specified time period by manipulating the average price paid history element 273.

The alternative selling rule entry page further includes at least one selling rule selection element 275 and selling rule value element 277. In the depicted example, a seller can manipulate the selling rule selection element 275 to choose a term type for which the seller wishes to enter a selling rule 132 (FIG. 1) associated with a product 126 (FIG. 1). The seller may then manipulate selling rule value element 277 to specify a selling rule 132 for entry into a seller table 121 (FIG. 1) via the selling rule entry system 117 (FIG. 1). It should be appreciated that various selling rules 132 associated with a product 126 offer may be entered using the depicted user interface, and that the depicted selling rules 132 are merely one example.

Figure 6:
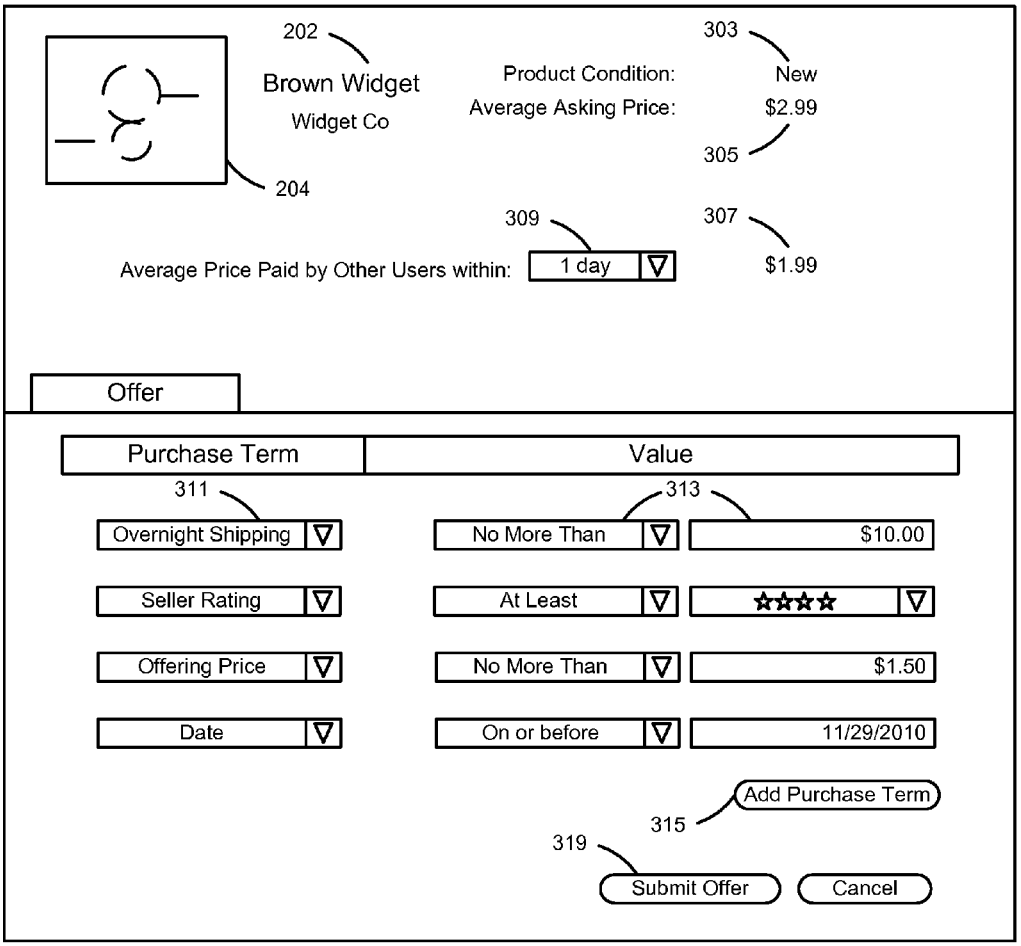
FIG. 6 is a drawing of an alternative example of a user interface that is generated on a client in the network by the electronic commerce system of FIG. 1 according to an embodiment of the present disclosure.

With reference to FIG. 6, shown is one example of a user interface 113*b* facilitating the entry of purchase offers in the electronic commerce system 104 (FIG. 1). The depicted user interface 113*b* may be hereinafter referred to as an offer entry page. The offer entry page communicates with the product entry system 135 (FIG. 1) to effectuate the entry and storage of offers to purchase a product in the user data store 144 (FIG. 1). In the depicted example, the offer entry page can also communicate further product details to a buyer, including a product description 202 and at least one product image 204 providing a visual depiction of the product. The offer entry page can also include other details of the product, including a condition indicator 303 that communicates the condition of the product. Further, the offer entry page can display an average asking price indicator 305, which can communicate the average asking price of the product via the matching engine 150 (FIG. 1) or other mechanism in the electronic commerce system 104. In other words, a buyer can be presented with the average asking price among a subset or all of the sellers offering the product 126 (FIG. 1) in the product data store 120 (FIG. 1).

The offer entry page can also include an average price paid indicator 307 and an average price paid history element 309, which can, in conjunction with one another, communicate to a buyer the average price paid for the product 126 by other buyers in the electronic commerce system 104. Further, the buyer may display the average price paid for the product 126 over a specified time period by manipulating the average price paid history element 309. Accordingly, such information may enable a buyer to submit an offer to purchase via the user interface 113*b* that is more likely to be matched by the matching engine 150 to an offer to sell extended by a seller in the electronic commerce system 104.

The offer entry page further includes at least one purchase term selection element 311 and purchase term value element 313. In the depicted example, a buyer can manipulate the purchase term selection element 311 to choose a term type for which the buyer wishes to enter a purchase term 143 (FIG. 1) associated with a purchase offer. The buyer may then manipulate purchase term value element 313 to specify a purchase term 143 (FIG. 1) for entry into the user data store 144 via the product entry system 135. For example, a buyer can specify a particular shipping method and a maximum cost that the buyer is willing to pay for the shipping method. Alternatively, the buyer may specify a seller rating or an offering price and thresholds associated with each term that must be met in order for a transaction to be consummated. It should be appreciated that various purchase terms 143 associated with a purchase offer may be entered using the depicted user interface, and that the depicted terms are merely one example.

Purchase term selection elements 311 and purchase term value elements 313 can also be pre-populated by the electronic commerce system 104 so that a potential buyer can submit an offer to purchase that is generated by the electronic commerce system 104. For example, the electronic commerce system 104 can determine the purchase terms 143 based on data regarding the marketplace and the market for a particular product. Accordingly, the electronic commerce system 104 can determine purchase terms 143 that may be desirable to buyers, and generate such an offer by populating purchase terms in the depicted user interface 113*b*.

Accordingly, a user can manipulate the additional purchase term element 315 to enter a plurality of purchase terms associated with a desired product and a binding offer to purchase the product in the electronic commerce system 104. The user can manipulate the offer submission element 319 to cause the product entry system 135 to store the desired product 141 and purchase term 143, or a purchase offer, in a product list 133 (FIG. 1) associated with the buyer in the user data store 144.

Figure 7:
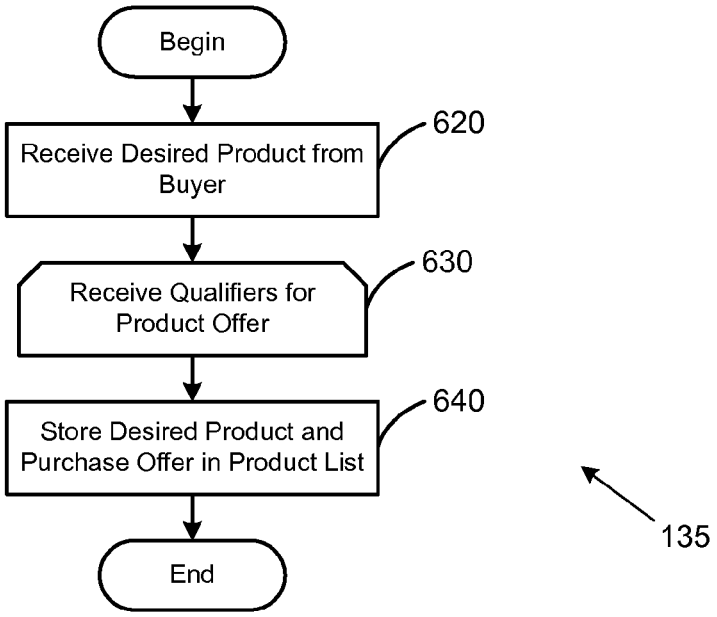
FIG. 7 is a flowchart depicting one example of execution of a product entry system implemented in the electronic commerce system of FIG. 1 according to an embodiment of the present disclosure.

Reference is now made to FIG. 7, which depicts one example of the execution of the product entry system 135. The flow chart may also be viewed as depicting a method in accordance with the disclosure. In box 620, a desired product 141 (FIG. 1) is received from a buyer extending a binding offer to purchase the desired product 141. Then, in box 630 the product entry system 135 can receive at least one purchase term 143 (FIG. 1) associated with the offer to purchase. As noted above, a purchase term 143 can represent a condition under which the buyer is willing to purchase a desired product 141 in the electronic commerce system 104. In box 640, an offer to purchase the desired product 141 is stored within the product list 133 (FIG. 1) associated with the buyer in the user data store 144.

Figure 8:
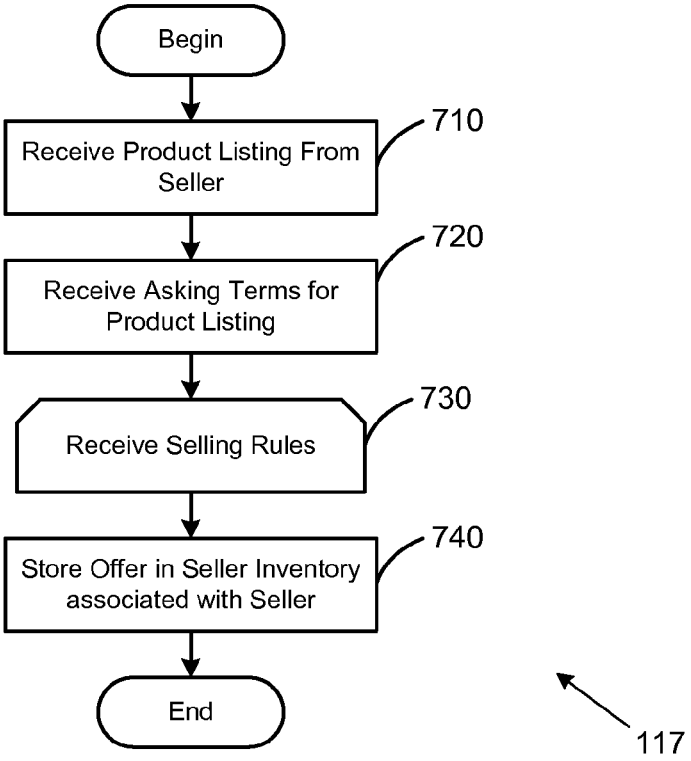
FIG. 8 is a flowchart depicting one example of execution of a selling rule entry system implemented in the electronic commerce system of FIG. 1 according to an embodiment of the present disclosure.

Reference is now made to FIG. 8, which depicts one example of the execution of the selling rule system 117 (FIG. 1). The flow chart may also be viewed as depicting a method in accordance with the disclosure. In box 710, the selling rule system 117 can receive a product listing from a seller in the electronic commerce system 104 (FIG. 1). Then, in box 720, a seller may define asking terms 131 (FIG. 1) associated with the product 126 (FIG. 1). In box 730, the selling rule system 117 can receive at least one selling rule 132 (FIG. 1) that authorizes the electronic commerce system 104 to modify the asking terms 131. Then, in box 740, the product 126, asking terms 131 and selling rule 132 are stored within the product data store 120.

Figure 9:
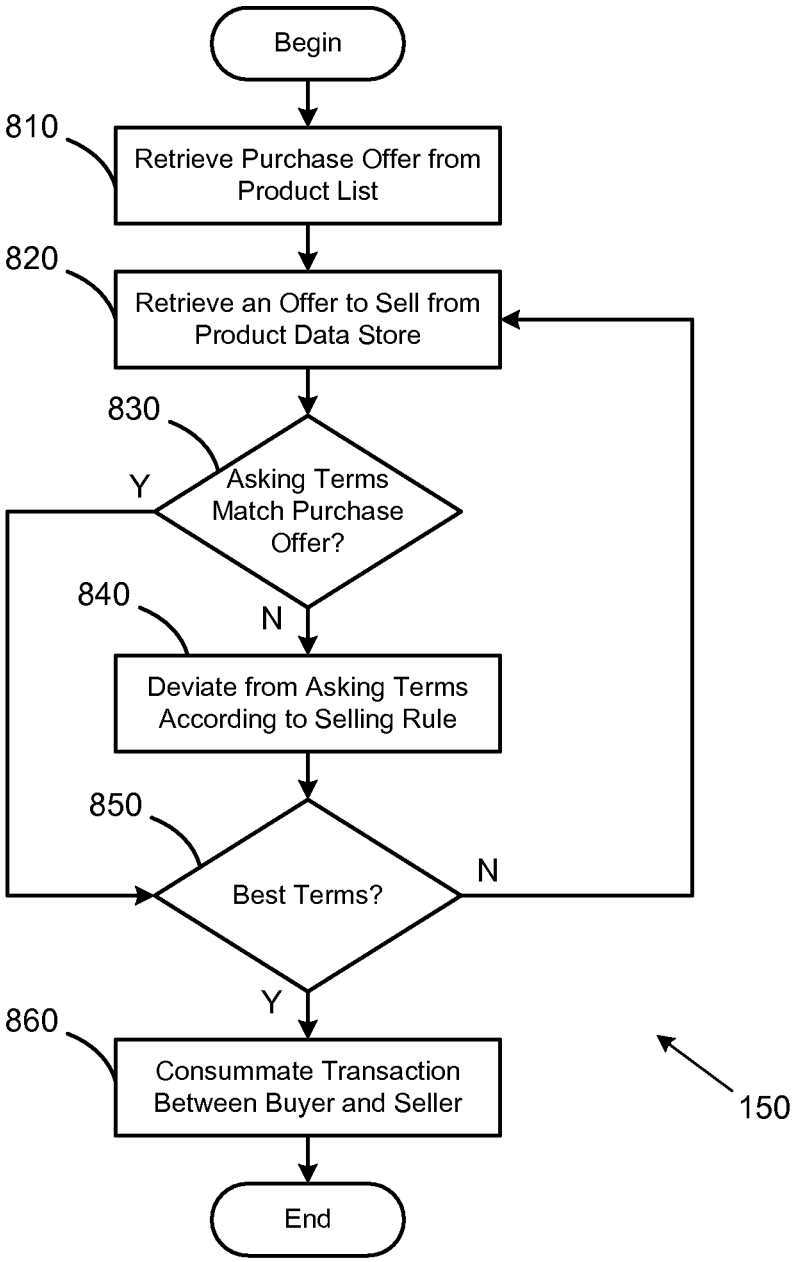
FIG. 9 is a flowchart depicting one example of execution of a matching engine implemented in the electronic commerce system of FIG. 1 according to an embodiment of the present disclosure.

With reference to FIG. 9, shown is one example of the execution of the matching engine 150 (FIG. 1). The flow chart may also be viewed as depicting a method in accordance with the disclosure. In box 810, the matching engine 150 can retrieve offers to purchase from the product list 133 (FIG. 1) within the user data store 144 (FIG. 1). Next, in box 820, offers to sell corresponding to the desired product 141 (FIG. 1) are retrieved from the product data store 120 (FIG. 1). In box 830, the matching engine 150 (FIG. 1) determines whether the asking terms 131 match the purchase term(s) 143 (FIG. 1) of the offer to purchase. If the terms do not match, then in box 840 the matching engine 150 determines whether at least one selling rule 132 can be applied to the asking terms 131 in order to authorize the electronic commerce system 104 to modify the asking terms 131 in order to match the terms of the purchase terms 143 corresponding to a desired product 141 in a product list 133 of the buyer.

Next, in box 850, the electronic commerce system 104 can determine the best terms from among the matched offers located in box 840. In other words, the electronic commerce system can rank the matched offers according to those that depart the least from the initial asking terms 131 or from the purchase terms 143. From the point of view of a seller in the electronic commerce system 104, a matched offer resulting in less of a departure from the initial asking terms 131 can be ranked as a transaction with better terms relative to a matched offer resulting in more of such a departure. Accordingly, in the step 860, a transaction can be consummated between buyer and seller in the electronic commerce system 104.

Figure 10:
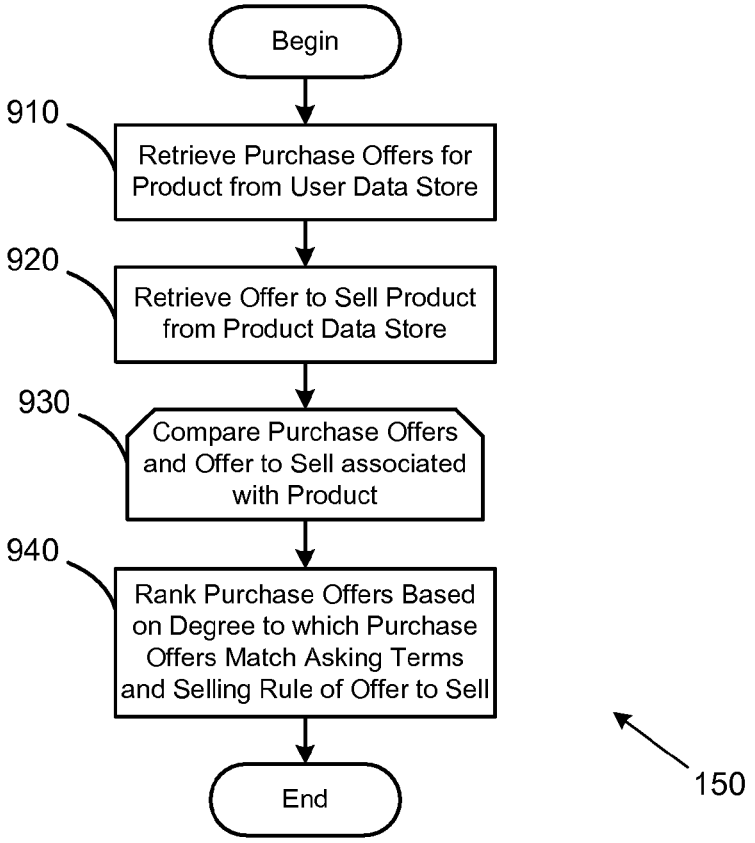
FIG. 10 is a flowchart depicting an alternative example of execution of a matching engine implemented in the electronic commerce system of FIG. 1 according to an embodiment of the present disclosure.

With reference to FIG. 10, shown is an alternative example of the execution of the matching engine 150 (FIG. 1). The flow chart may also be viewed as depicting a method in accordance with the disclosure. In box 910 purchase offers associated with a desired product 141 (FIG. 1) are retrieved from the user data store 144 (FIG. 1). Then, in box 920 an offer to sell a product 126 (FIG. 1) is retrieved from the product data store 120 (FIG. 1). In box 930, the retrieved purchase offers are compared to the retrieved offer to sell in order to, as described above, determine the degree to which the purchase offers match the asking terms 131 (FIG. 1) and selling rules 132 associated with a product 126 in the seller inventory 123. In step 940, the purchase offers associated with a desired product 141 can be ranked according to the degree to which they match the terms of the retrieved offer to sell.

Figure 11:
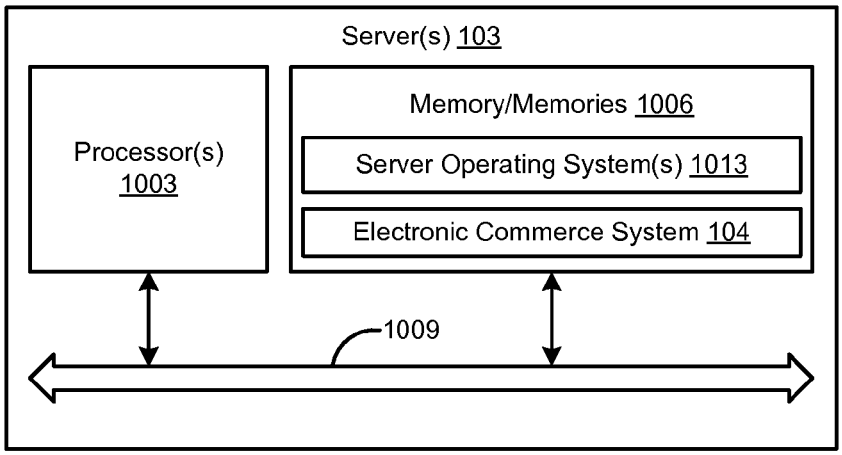
FIG. 11 is a block diagram of one example embodiment of a server in the network of FIG. 1 according to an embodiment of the present disclosure.

With reference to FIG. 11, shown is one example of a server 103 that comprises a computer server or equivalent device according to an embodiment of the present disclosure. The server 103 may include one or more processor circuits having a processor 1003 and a memory 1006, both of which are coupled to a local interface 1009. In this respect, the local interface 1009 may comprise, for example, a data bus with an accompanying control/address bus as can be appreciated.

Stored on the memory 1006 and executable by the processor 1003 are various components such as a server operating system 1013 and the electronic commerce system 104. In addition, it is understood that many other components may be stored in the memory 1006 and executable by the processor(s) 1003. Also, such components may reside in a memory that is external from the server 103 as can be appreciated.

As set forth above, a number of components are stored in the memory 1006 and are executable by the processor 1003. In this respect, the term "executable" refers to a program file that is in a form that can ultimately be run by the processor 1003. Examples of executable programs may be, for example, a compiled program that can be translated into machine code in a format that can be loaded into a random access portion of the memory 1006 and run by the processor 1003, or source code that may be expressed in proper format such as object code that is capable of being loaded into a random access portion of the memory 1006 and executed by the processor 1003. An executable program may be stored in any portion or component of the memory 1006 including, for example, random access memory, read-only memory, a hard drive, compact disk (CD), floppy disk, or other memory components.

The memory 1006 is defined herein as both volatile and nonvolatile memory and data storage components. Volatile components are those that do not retain data values upon loss of power. Nonvolatile components are those that retain data upon a loss of power. Thus, the memory 1006 may comprise, for example, random access memory (RAM), read-only memory (ROM), hard disk drives, floppy disks accessed via an associated floppy disk drive, compact discs accessed via a compact disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

In addition, the processor 1003 may represent multiple processors and the memory 1006 may represent multiple memories that operate in parallel. In such a case, the local interface 1009 may be an appropriate network that facilitates communication between any two of the multiple processors, between any processor and any one of the memories, or between any two of the memories, etc. The processor 1003 may be of electrical, optical, or of some other construction as can be appreciated by those with ordinary skill in the art.

The server operating system 1013 is executed to control the allocation and usage of hardware resources such as the memory and processing time in the server 103. In this manner, the server operating system 1013 serves as the foundation on which applications depend as is generally known by those with ordinary skill in the art.

Although the functionality of various embodiments are described above with respect to FIGS. 1-10 as being embodied in software or code executed by general purpose hardware as discussed above, as an alternative the same may also be embodied in dedicated hardware or a combination of software/general purpose hardware and dedicated hardware. If embodied in dedicated hardware, the functionality of these components can be implemented as a circuit or state machine that employs any one of or a combination of a number of technologies. These technologies may include, but are not limited to, discrete logic circuits having logic gates for implementing various logic functions upon an application of one or more data signals, application specific integrated circuits having appropriate logic gates, programmable gate arrays (PGA), field programmable gate arrays (FPGA), or other components, etc. Such technologies are generally well known by those skilled in the art and, consequently, are not described in detail herein.

The flow charts of FIGS. 7-10 show the functionality and operation of an implementation of the server 103. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor in a computer system or other system. The machine code may be converted from the source code, etc. If embodied in hardware, each block may represent a circuit or a number of interconnected circuits to implement the specified logical function(s).

Although the flow charts of FIG. 7-10 show a specific order of execution, it is understood that the order of execution may differ from that which is depicted. For example, the order of execution of two or more blocks may be scrambled relative to the order shown. Also, two or more blocks shown in succession in FIGS. 7-10 may be executed concurrently or with partial concurrence. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, where the functionality of the disclosed systems is expressed in the form of software or code, it can be embodied in any computer-readable medium for use by or in connection with an instruction execution system such as, for example, a processor in a computer system or other system. In this sense, the functionality may comprise, for example, statements including instructions and declarations that can be fetched from the computer-readable medium and executed by the instruction execution system. In the context of the present disclosure, a "computer-readable medium" can be any medium that can contain, store, or maintain the network page for use by or in connection with the instruction execution system.

The computer readable medium can comprise any one of many physical media such as, for example, electronic, magnetic, optical, or semiconductor media. More specific examples of a suitable computer-readable medium would include, but are not limited to, magnetic tapes, magnetic floppy diskettes, magnetic hard drives, or compact discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

It should be emphasized that the above-described embodiments of the present disclosure are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present disclosure and protected by the following claims.

Therefore, having thus described the invention, at least the following is claimed:

1. A method, comprising:

generating, via at least one of one or more computing devices, a selling rule user interface associated with an electronic commerce system, the selling rule user interface configured to facilitate receiving at least one selling rule from a seller, the selling rule user interface comprising an asking term selection component, a value entry component, and a timing price component, the at least one selling rule associated with an offer to sell a product extended by the seller, the at least one selling rule authorizing a deviation from one of a plurality of asking terms of the offer to sell in order to consummate a transaction for sale of the product by matching the plurality of the asking terms of the offer to sell with at least one purchase term of a purchase offer that is pending, the asking term selection component configured to receive a selection of the one of the plurality of asking terms, and the value entry component configured to receive a value associated with the deviation from the one of the plurality of asking terms, and the timing price component configured to present a pricing of the product over a period of time;

causing, via at least one of the one or more computing devices, the selling rule user interface to be transmitted to a seller device associated with the seller;

causing, via at least one of the one or more computing devices, the at least one selling rule to be stored in a storage device associated with the electronic commerce system in response to receiving the at least one selling rule from the seller device, individual ones of the plurality of asking terms comprising at least one of a price, a shipping method, a buyer rating, a payment method, a plurality of seller payment terms, or a buyer reputation, and the at least one selling rule comprising at least one price associated with the product that varies from an initial price of the product in the plurality of asking terms and at least one temporal modifier authorizing a modification of the plurality of asking terms on a specified future date;

generating, via at least one of the one or more computing devices, a purchase offer user interface associated with the electronic commerce system, the purchase offer user interface configured to receive the purchase offer from a buyer to purchase the product, the purchase offer specifying the at least one purchase term, the at least one purchase term comprising the at least one of the price, the shipping method, a seller rating, the payment method, a plurality of buyer payment terms, or a seller reputation;

causing, via at least one of the one or more computing devices, the purchase offer user interface to be transmitted to a buyer device associated with the buyer;

causing, via at least one of the one or more computing devices, the purchase offer from the buyer to purchase the product to be stored in the storage device associated with the electronic commerce system in response to receiving the purchase offer from the buyer device;

generating, via at least one of the one or more computing devices, a ranking of a plurality of purchase offers from a plurality of buyers based at least in part upon a degree to which a respective at least one purchase term of the plurality of purchase offers matches the one of the plurality of asking terms of the offer to sell, the plurality of purchase offers including the purchase offer from the buyer as a top ranked purchase offer in the ranking;

determining, via at least one of the one or more computing devices, that the plurality of asking terms of the offer to sell fails to match the at least one purchase term of the purchase offer;

determining, via at least one of the one or more computing devices, that the at least one selling rule can be applied to the one of the plurality of asking terms;

authorizing the deviation from the one of the plurality of asking terms by the value that matches the at least one purchase term of the purchase offer;

consummating, via at least one of the one or more computing devices, the transaction between the seller and the buyer according to the at least one selling rule.

2. The method of claim 1, further comprising:

receiving, via at least one of the one or more computing devices, a request to add the product to a wish list associated with at least one buyer;

receiving, via at least one of the one or more computing devices, the at least one purchase term with the request to add the product to the wish list associated with the at least one buyer; and designating, via at least one of the one or more computing devices, the request to add the product to the wish list as an offer to purchase the product from the at least one buyer.

3. A method, comprising:

generating, via at least one of one or more computing devices, a selling rule user interface associated with an electronic commerce system, the selling rule user interface comprising an asking term selection component and a value entry component to facilitate receiving at least one selling rule from a seller, the at least one selling rule associated with an offer to sell a product extended by the seller, the at least one selling rule authorizing a deviation from one of a plurality of asking terms of an offer to sell in order to consummate a transaction for sale of the product by matching the plurality of the asking terms of the offer to sell with at least one purchase term of a purchase offer that is pending, the asking term selection component configured to receive a selection of the one of the plurality of asking terms, and the value entry component configured to receive a value associated with the deviation from the one of the plurality of asking terms of the offer to sell;

causing, via at least one of the one or more computing devices, the selling rule user interface to be transmitted to a seller device associated with the seller;

causing, via at least one of the one or more computing devices, the at least one selling rule to be stored in a server associated with the electronic commerce system in response to receiving the at least one selling rule from the seller device;

generating, via at least one of the one or more computing devices, a purchase offer user interface associated with the electronic commerce system, the purchase offer user interface configured to receive the purchase offer from a buyer to purchase the product, the purchase offer specifying at least one purchase term;

causing, via at least one of the one or more computing devices, the purchase offer user interface to be transmitted to a buyer device associated with the buyer;

causing, via at least one of the one or more computing devices, a plurality of purchase offers from a plurality of buyers to be stored in the server associated with the electronic commerce system, the plurality of purchase offers including the purchase offer from the buyer;

generating, via at least one of the one or more computing devices, a ranking of the plurality of purchase offers based at least in part upon a degree to which a respective at least one purchase term of the plurality of purchase offers matches the one of the plurality of asking terms;

determining, via at least one of the one or more computing devices, that the plurality of asking terms of the offer to sell fails to match the respective at least one purchase term of the plurality of purchase offers by order of the ranking; and consummating, via at least one of the one or more computing devices, a transaction between the seller and the buyer according to the at least one selling rule, wherein the at least one selling rule is applied to the one of the plurality of asking terms to deviate from the one of the plurality of asking terms by the value to match the at least one purchase term of the purchase offer in order to consummate the transaction for sale of the product.

4. The method of claim 3, further comprising consummating, via at least one of the one or more computing devices, one or more additional transactions between the seller and selected ones of the plurality of purchase offers according to the at least one selling rule by order of the ranking.

5. The method of claim 3, wherein the at least one purchase term is at least one of a price, a shipping method, a seller rating, a payment method, a plurality of buyer payment terms, or a seller reputation.

6. The method of claim 3, wherein the plurality of asking terms comprise at least one of a price, a shipping method, a buyer rating, a payment method, a plurality of seller payment terms, or a buyer reputation.

7. The method of claim 3, wherein the at least one selling rule comprises at least one price associated with the product that varies from an initial price of the product in the one of the plurality of asking terms.

8. The method of claim 3, wherein the at least one selling rule includes at least one settlement term associated with the offer to sell that differs from a respective settlement term in the plurality of asking terms.

9. The method of claim 8, wherein the at least one settlement term is at least one of a shipping method, a payment method, a shipping date, or a product condition.

10. The method of claim 3, wherein the selling rule user interface further comprises a timing price component, the timing price component comprising a temporal entry element and a timeline element, the temporal entry element configured to receive a temporal indicator and the timeline element configured to graphically display the plurality of asking terms over time.

11. The method of claim 3, further comprising notifying, via at least one of the one or more computing devices, a potential buyer of an average price of a plurality of transactions previously consummated for the product.

12. A method comprising:

generating, via at least one of one or more computing devices, a selling rule user interface associated with an electronic commerce system, the selling rule user interface comprising an asking term selection component and a value entry component to facilitate receiving at least one selling rule from a seller, the at least one selling rule associated with an offer to sell a product extended by the seller, the at least one selling rule authorizing a deviation from one of a plurality of asking terms of the offer to sell in order to match the plurality of asking terms of the offer to sell with at least one purchase term of a purchase offer that is pending, the asking term selection component configured to receive a selection of the one of the plurality of asking terms, and the value entry component configured to receive a value associated with the deviation from the one of the plurality of asking terms;

causing, via the at least one of one or more computing devices, the selling rule user interface to be transmitted to a seller device associated with the seller;

storing, via the at least one of one or more computing devices, the at least one selling rule in a server associated with the electronic commerce system in response to receiving the at least one selling rule from the seller device;

generating, via the at least one of one or more computing devices, a purchase offer user interface associated with the electronic commerce system, the purchase offer user interface configured to receive the purchase offer from a buyer to purchase the product, the purchase offer specifying the at least one purchase term;

causing, via the at least one of one or more computing devices, the purchase offer user interface to be transmitted to a buyer device associated with the at buyer;

storing, via the at least one of one or more computing devices, a plurality of purchase offers from a plurality of buyers in a server associated with the electronic commerce system, the plurality of purchase offers including the purchase offer from the buyer;

determining, via the at least one of one or more computing devices, a degree to which a respective at least one purchase term of the plurality of purchase offers matches the one of the plurality of asking terms based at least in part on the value received from the seller via the selling rule user interface;

generating, via the at least one of one or more computing devices, a ranking of the plurality of purchase offers based at least in part upon the degree of match;

generating, via the at least one of one or more computing devices, an offers network page including the plurality of purchase offers by order of the ranking;

transmitting, via the at least one of one or more computing devices, the offers network page to the seller device; and consummating, via the at least one of one or more computing devices, a transaction between the seller and a selected one of the plurality of purchase offers according to the at least one selling rule, wherein the purchase offer from the buyer is selected and the at least one purchase term of the purchase offer is matched with the plurality of asking terms of the offer to sell after applying the deviation from the one of the plurality of asking terms.

13. The method of claim 12, further comprising consummating one or more additional transactions between the seller and one or more additional buyers of selected one or more additional purchase offers according to the at least one selling rule by order of the ranking.

14. The method of claim 12, wherein the at least one purchase term is at least one of a price, a shipping method, a seller rating, a payment method, a buyer payment term, or a seller reputation.

15. The method of claim 12, wherein the plurality of asking terms comprise at least one of a price, a shipping method, a buyer rating, a payment method, a seller payment term, or a buyer reputation.

16. The method of claim 12, wherein the at least one selling rule comprises at least one price associated with the product that varies from an initial price of the product in the one of the plurality of asking terms.

17. The method of claim 12, wherein the at least one selling rule includes at least one settlement term associated with the offer that differs from a respective settlement term in the plurality of asking terms.

18. The method of claim 17, wherein the at least one settlement term is at least one of a shipping method, a payment method, a shipping date, or a product condition.

19. The method of claim 12, wherein the selling rule user interface further comprises a timing price component, the timing price component comprising a temporal entry element and a timeline element, the temporal entry element configured to receive a temporal indicator, and the timeline element being configured to graphically display the asking terms over time.

20. The method of claim 12, further comprising notifying a potential buyer of an average price of a plurality transactions previously consummated for the product.

21. The method of claim 12, further comprising:

receiving a request to add the product to a wish list associated with at least one buyer;

receiving the at least one purchase term with the request to add the product to the wish list associated with the at least one buyer; and designating the request to add the product to the wish list as an offer to purchase the product from the at least one buyer.

22. A system, comprising:

at least one computing device;

an application executable by the at least one computing device, the application configured to at least:

generate a selling rule user interface associated with an electronic commerce system, the selling rule user interface comprising an asking term selection component and a value entry component to facilitate receiving at least one selling rule from a seller, the at least one selling rule associated with an offer to sell a product extended by the seller, the at least one selling rule authorizing a deviation from one of a plurality of asking terms of the offer to sell in order to match the plurality of asking terms of the offer to sell with at least one purchase term of a purchase offer that is pending, the asking term selection component configured to receive a selection of the one of the plurality of asking terms, and the value entry component configured to receive a value associated with the deviation from the one of the plurality of asking terms;

cause the selling rule user interface to be transmitted to a seller device associated with the seller;

store the at least one selling rule in a server associated with the electronic commerce system in response to receiving the at least one selling rule from the seller device;

generate a purchase offer user interface associated with the electronic commerce system, the purchase offer user interface configured to receive the purchase offer from a buyer to purchase the product, the purchase offer specifying the at least one purchase term;

cause the purchase offer user interface to be transmitted to a buyer device associated with the buyer;

store a plurality of purchase offers from a plurality of buyers in a server associated with the electronic commerce system, the plurality of purchase offers including the purchase offer from the buyer;

determine a ranking of the plurality of purchase offers based at least in part upon a degree to which a respective at least one purchase term of the plurality of purchase offers matches the one of the plurality of asking terms based at least in part on the value received from the seller via the selling rule user interface; and consummate a transaction between the seller and a selected one of the plurality of purchase offers according to the at least one selling rule, wherein the purchase offer from the buyer is selected and the at least one purchase term of the purchase offer is matched with the plurality of asking terms of the offer to sell after the deviation is applied from the one of the plurality of asking terms.

23. The system of claim 22, wherein the application is further configured to at least consummate one or more additional transactions between the seller and one or more additional buyers of selected one or more additional purchase offers according to the at least one selling rule by order of the ranking.

24. A method, comprising:

generating, via at least one of the one or more computing devices, a selling rule user interface associated with an electronic commerce system, the selling rule user interface comprising an asking term selection component and a value entry component to facilitate receiving at least one selling rule from a seller, the at least one selling rule associated with an offer to sell a product extended by the seller, the at least one selling rule authorizing a deviation from one of a plurality of asking terms of an offer, the asking term selection component configured to receive a selection of the one of the plurality of asking terms, and the value entry component configured to receive a value associated with the deviation from the one of the plurality of asking terms;

causing, via at least one of the one or more computing devices, the selling rule user interface to be transmitted to a seller device associated with the seller;

generating, via at least one of the one or more computing devices, a purchase offer user interface associated with the electronic commerce system, the purchase offer user interface configured to receive a purchase offer from a buyer to purchase the product, the purchase offer having at least one purchase term, and the at least one purchase term being a condition under which the buyer offers to purchase the product;

causing, via at least one of the one or more computing devices, the purchase offer user interface to be transmitted to a buyer device associated with the buyer;

determine a ranking, via at least one of the one or more computing devices, of a plurality of purchase offers from a plurality of buyers based at least in part upon a degree to which a respective at least one purchase term of the plurality of purchase offers matches the one of the plurality of asking terms, the plurality of purchase offers including the purchase offer from the buyer;

matching, via at least one of the one or more computing devices, by order of the ranking, a selected plurality of the purchase offers to the offer to sell to form a plurality of matched offers, wherein matching further comprises modifying the one of the plurality of asking terms of the offer to sell according to the at least one selling rule to match the at least one purchase term of the purchase offer in order to consummate a transaction for sale of the product between the seller and the buyer; and consummating, via at least one of the one or more computing devices, the transaction between the buyer and the seller under the terms of the matched offers.

25. The method of claim 24, wherein the at least one selling rule comprises at least one price associated with the product that varies from an initial price of the product in the one of the plurality of asking terms.

26. The method of claim 24, wherein the at least one selling rule includes at least one future price, the at least one future price configured to modify the one of the plurality of asking terms on a specified future date.

27. A method comprising:

generating, via at least one of one or more computing devices, a selling rule user interface associated with an electronic commerce system, the selling rule user interface comprising an asking term selection component and a value entry component to facilitate receiving at least one selling rule from a seller, the at least one selling rule associated with an offer to sell a product extended by the seller, the at least one selling rule authorizing a deviation from one of a plurality of asking terms of the offer to sell, the asking term selection component configured to receive a selection of the one of the plurality of asking terms, and the value entry component configured to receive a value associated with the deviation from the one of the plurality of asking terms;

causing, via the at least one of one or more computing devices, the selling rule user interface to be transmitted to a seller device associated with the seller;

generating, via the at least one of one or more computing devices, a purchase offer user interface associated with the electronic commerce system, the purchase offer user interface configured to receive a purchase offer from a buyer to purchase the product, the purchase offer having at least one purchase term, and the at least one purchase term being a condition under which the buyer offers to purchase the product;

causing, via the at least one of one or more computing devices, the purchase offer user interface to be transmitted to a buyer device associated with the buyer;

generating, via the at least one of one or more computing devices, a ranking of a plurality of purchase offers from a plurality of buyers based at least in part upon a degree to which a respective at least one purchase term of the plurality of purchase offers matches the one of the plurality of asking terms, the plurality of purchase offers including the purchase offer from the buyer;

modifying, via the at least one of one or more computing devices, the one of the plurality of asking terms according to the authorized deviation specified by the at least one selling rule to match the at least one purchase term of the purchase offer;

matching, via the at least one of one or more computing devices, by order of the ranking, a selected plurality of the purchase offers to the offer to sell to form a plurality of matched offers, the selected plurality of purchase offers including the purchase offer of the buyer; and consummating, via the at least one of one or more computing devices, a plurality of transactions between multiple buyers for the selected plurality of purchase offers and the seller under the terms of the matched offers, wherein the multiple buyers include the buyer.

28. The method of claim 27, wherein the one of the plurality of asking terms comprise at least one of a price, a shipping method, a buyer rating, a payment method, a seller payment term, or a buyer reputation.

29. The method of claim 27, wherein the at least one selling rule comprises at least one price associated with the product that varies from an initial price of the product in the plurality of asking terms.

30. The method of claim 27, wherein the at least one selling rule includes at least one future price, the at least one future price configured to modify the one of the plurality of asking terms on a specified future date.

* * * * *